US011033136B2

(12) United States Patent
Kutas et al.

(10) Patent No.: US 11,033,136 B2
(45) **Date of Patent: *Jun. 15, 2021**

(54) HOME WALL INSERT MAILBOX WITH CONVENIENT BOX HANDLING FEATURES

(71) Applicants: Jeffrey Robert Kutas, Granbury, TX (US); Brian Lang, Poolville, TX (US)

(72) Inventors: Jeffrey Robert Kutas, Granbury, TX (US); Brian Lang, Poolville, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/692,722

(22) Filed: Nov. 22, 2019

(65) Prior Publication Data

US 2020/0085222 A1 Mar. 19, 2020

Related U.S. Application Data

(63) Continuation-in-part of application No. 16/003,815, filed on Jun. 8, 2018, now Pat. No. 10,517,417.

(60) Provisional application No. 62/518,109, filed on Jun. 12, 2017.

(51) Int. Cl.

| | |
|---|---|
| ***A47G 29/12*** | (2006.01) |
| ***A47G 29/16*** | (2006.01) |
| ***A47G 29/20*** | (2006.01) |
| ***A47G 29/22*** | (2006.01) |
| ***A47G 29/14*** | (2006.01) |

(52) U.S. Cl.

CPC ... *A47G 29/12095* (2017.08); *A47G 29/1214* (2013.01); *A47G 29/141* (2013.01); *A47G 29/16* (2013.01); *A47G 29/20* (2013.01); *A47G 29/22* (2013.01); *A47G 2029/145* (2013.01); *A47G 2029/148* (2013.01)

(58) Field of Classification Search

CPC ..... A47G 29/12095; A47G 29/12097; A47G 29/1248; A47G 29/1251; A47G 29/141; A47G 29/16; A47G 29/20; A47G 29/22; A47G 2029/144; A47G 2029/148; A47G 29/1214; A47G 2029/145

USPC ..... 232/17, 19, 29, 45, 47, 51, 43.3, 43.4, 232/43.5

See application file for complete search history.

(56) References Cited

U.S. PATENT DOCUMENTS

| | | | |
|---|---|---|---|
| 4,757,942 | A | 7/1988 | Young, Jr. |
| 5,137,212 | A | 8/1992 | Fiterman et al. |
| 5,435,484 | A | 7/1995 | Carlson |
| 5,449,111 | A | 9/1995 | Sauzedde et al. |
| 5,938,113 | A | 8/1999 | Kim |

(Continued)

*Primary Examiner* — William L Miller

(74) *Attorney, Agent, or Firm* — Optima Law Group, APC; Thomas E. Jurgensen; Craig W. Barber

(57) ABSTRACT

The present invention teaches a residential wall penetrating mailbox with enhanced box handling capability, openable by barcode scanning, and openable from either inside or outside a home. A body which is generally column shaped has front and rear doors which open at the top and hinge near the bottom and which have interleaved fingers or members extending from the bottom ends into the interior space of the mailbox. A box tray sits on the interleaved fingers. When either door is opened the fingers of that door lift the box tray upward and out of the box on that side. Thus, a delivery person may access a box from outside the home, while the homeowner may do the same without leaving the safety of the home interior. In addition, an elastic cord and carefully slanted slots on side panels of the front door allow easy retention of a box even further up the front door.

5 Claims, 9 Drawing Sheets

(56) References Cited

U.S. PATENT DOCUMENTS

| | | | | |
|---|---|---|---|---|
| 6,375,071 | B1 | 4/2002 | Kim | |
| 6,378,767 | B1 | 4/2002 | Steele | |
| 6,483,433 | B2 | 11/2002 | Moskowitz et al. | |
| 6,879,255 | B1 | 4/2005 | Jezierski | |
| 6,987,452 | B2 | 1/2006 | Yang | |
| 7,123,147 | B2 | 10/2006 | Engel | |
| 7,252,220 | B1 | 8/2007 | Shreve | |
| 7,320,427 | B2 | 1/2008 | Prestwich | |
| 7,337,944 | B2 | 3/2008 | Devar | |
| 7,516,880 | B1 | 4/2009 | Crain et al. | |
| 7,843,340 | B2 | 11/2010 | Davis | |
| 7,854,374 | B2 | 12/2010 | Dudley | |
| 7,946,472 | B2 | 5/2011 | Bolles | |
| 8,261,966 | B2 | 9/2012 | Cox et al. | |
| 8,299,923 | B2 | 10/2012 | Hammoud | |
| 8,573,473 | B1 | 11/2013 | Farentinos et al. | |
| 9,004,346 | B2 * | 4/2015 | Farentinos ..... | A47G 29/22 232/43.3 |
| 2004/0211827 | A1 | 10/2004 | Gunvaldson | |
| 2008/0067227 | A1 | 3/2008 | Poss et al. | |
| 2010/0127063 | A1 | 5/2010 | Bolles | |
| 2011/0210166 | A1 | 9/2011 | Dinh | |
| 2013/0020384 | A1 | 1/2013 | Corey | |
| 2015/0021386 | A1 | 1/2015 | Farentinos et al. | |
| 2017/0156533 | A1 | 6/2017 | Pajonas | |

* cited by examiner

Figure 3
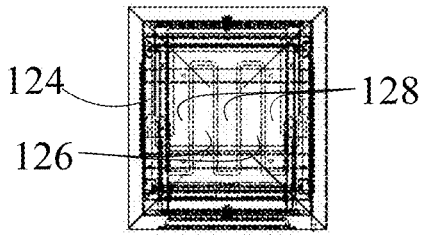
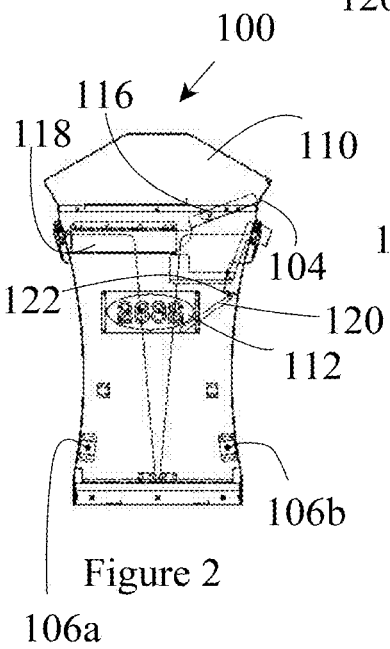
Figure 2
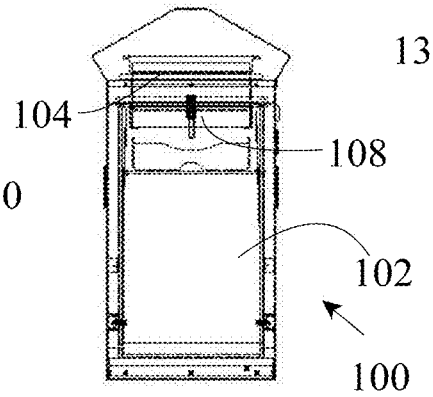
Figure 1
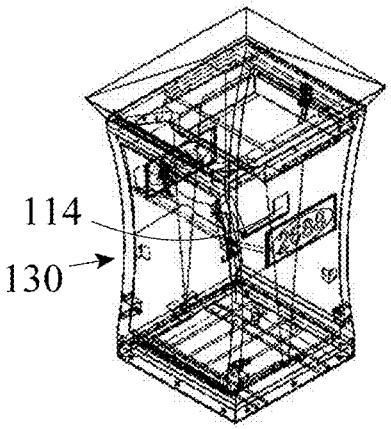
Figure 4

Figure 12
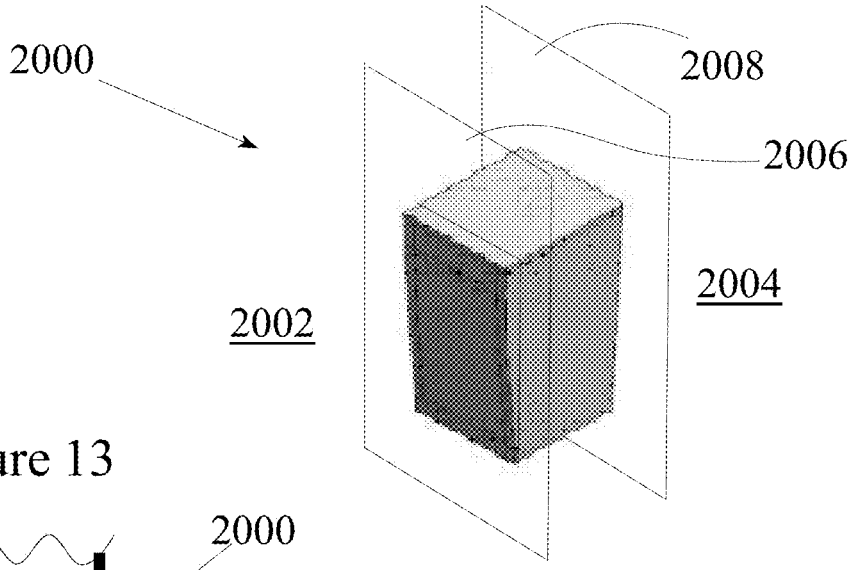
Figure 13
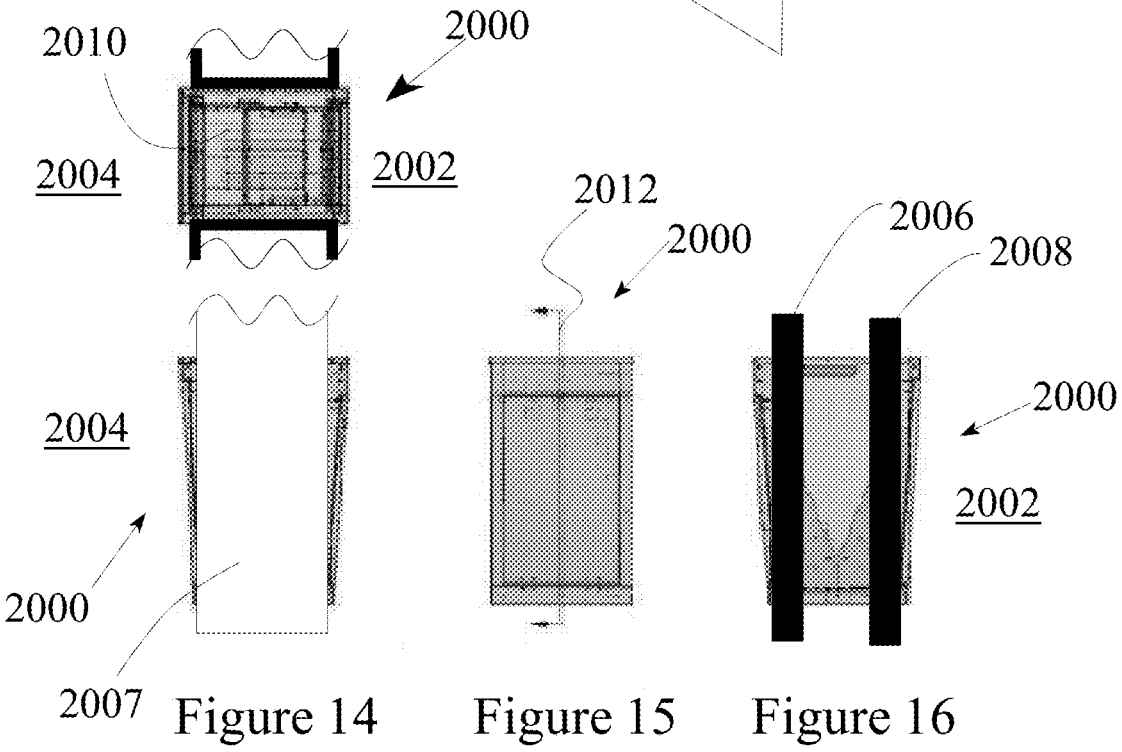
Figure 14 Figure 15 Figure 16

HOME WALL INSERT MAILBOX WITH CONVENIENT BOX HANDLING FEATURES

RELATED APPLICATION(S)

This application claims the benefit of U.S. patent application Ser. No. 62/518,109 filed Jun. 12, 2017 in the name of the inventors, Jeffrey Robert Kutas and Brian Lang, and claims the priority and benefit of co-pending U.S. application Ser. No. 16/003,815, in the name of the same inventors, Jeffrey Robert Kutas and Brian Lang, and having a filing date of Jun. 8, 2018, for which priority and benefit are claimed and the entire disclosures of which are incorporated herein by this reference.

FIELD OF THE INVENTION

The present invention relates generally to mailboxes and more specifically to home wall penetrating mailboxes with expanded box handling features and convenience features.

BACKGROUND

Residential home mailboxes of the wall mounted type are usually either a simple slot with a covering flap which penetrates a door, or they are mounted on the exterior of the home only. For the first type, the mail delivery person slides letters through the slot, and the home owner finds the letters laying on the floor inside the door when they return home. For the latter type, the mail delivery person puts letters into the box hanging on the outside of the wall of the house and the resident checks the mail by walking outside to the mailbox. This latter type can also be mounted on a small pole or the like.

However, both of these types have numerous disadvantages.

In the case of the slot type, packages cannot really be used with the slot. Normally packages are simply left on a front porch, with the risks of theft, weather damage and animal interest all inherent in this procedure. Also, it is often true that as the door swings open the mail on the floor is crumpled, ripped, or otherwise damaged. Finally, the homeowner probably does not really enjoy bending over and scraping their mail off their floor with their fingernails every day. (For this reason, some slot types mail boxes penetrate a house wall instead of a door, and feature a small shelf on the interior wall which tends to retain most letters shoved through the slot.)

In the case of the external mail box on the other hand, the mail box is at least normally mounted a bit off the ground, for convenient access. However, the space inside of the box is usually limited. Some exterior-wall-hung mail boxes are barely longer than a business size envelope and only a few inches deep and wide, making their effective capacity smaller than a door slot type. Once again, delivered packages are just left on a front porch, again with the risks of theft, weather damage and animal interactions.

Noticeably, neither type will handle a package much larger than an envelope.

Homeowners of curbside mailboxes experience other problems. One very common issue, especially in the age of constant on-line ordering, is the irritation surrounding return of packages which do not fit in the standard size of curbside mailbox. A purchaser who wishes to return a product via mail will have to go online, get a mailing label from the seller, and then notify the mail delivery person (via a note on the curbside box or whatever) that they have a box which needs to be returned. Also, packages have to be retrieved via the street side of the box and so forth.

It would be preferable to provide a residential home mailbox which works to provide indoor or outdoor access to packages, provides a safe place for packages to be stored out of the elements, locked, and inaccessible.

It would further be preferable to provide a residential home mailbox which allows a mail delivery person to access packages within the box without need for a special key.

US Patent Application Publication No. 2008/0067227, published Mar. 20, 2008 in the name of Poss et al, teaches a package deposit enclosure for public use, not residential use. It lacks the ability to lift packages in either direction when opened, to scan barcodes for entry and modular renovation and improvement.

U.S. Pat. No. 8,261,966 issued Sep. 11, 2012 in the name of Cox et al, teaches a residential mailbox having a column style mailbox with various doors and supports but no indication of easy renovation and modular improvement.

U.S. Pat. No. 7,854,374 issued Dec. 21, 2010 in the name of Dudley, teaches at least multiple mail handling compartments and multiple doors for convenient access in different ways. However, it lacks the ability to lift packages from the bottom for easy handling from either side.

U.S. Pat. No. 6,987,452 issued Jan. 17, 2006 in the name of Yang teaches an "iBox", an intelligent mailbox having communication capabilities but lacking basic mail handling functions, the ability to be easy accessed from either curbside or sidewalkside, does not cooperate with barcodes and so on.

U.S. Pat. No. 6,879,255 issued Apr. 12, 2005 in the name of Jezierski teaches a mailbox cam retrofit to a traditional mailbox, which transmits an image from the box, but which lacks security features for the homeowner's security (rather than just box security), and does not teach any usability with bar codes, lacks a scanner, lacks convenience features for the curbside/sidewalkside problem and so on.

U.S. Pat. No. 6,483,433 issued Nov. 19, 2002 in the name of Moskowitz et al teaches a computer system for determining if a package has been placed in a depository, but lacks any physical mail box structure.

It would be preferable to provide a mail box which has none of these limitations.

It would further be preferable to provide a mail box which can be easily semi-customized or renovated in a modular manner to a higher level of structural features and capabilities.

SUMMARY OF THE INVENTION

The present invention teaches a residential home wall insert mailbox with enhanced box handling capability, openable by barcode scanning, which can be accessed by delivery persons outside the wall of the home or by the homeowner inside the home.

A body which is generally column-shaped has front and rear sides having respective front and rear doors which open at the top and hinge near the bottom. The body is placed in the wall of a home to allow packages to be delivered from one door on the outside of the house and retrieved from a different door on the inside of the house. A bonnet caps the columnar body of the curbside options.

The front and rear doors have interleaved fingers or members extending from the bottom ends into the interior space of the mailbox. A box tray sits on the interleaved fingers. The center of gravity of the box tray sit within the ambit of both sets of interleaved fingers/members, so either set of fingers can provide stable support for the box tray without the other set of fingers. When either door is opened the fingers of that door lift the box tray upward and out of the box on that side. Thus, a delivery person may access a box without leaving a delivery vehicle, while the homeowner may do the same without leaving the safety of the interior of the home.

In addition, an elastic cord and carefully slanted slots on side panels of the front door allow easy retention of a box even further up the front door. The elastic cord is attached to fasteners which ride in two slots which are angled relative to the vertical axis of the column and which are cut through side panels of the front door. The side panels sit within the columnar body when the front door is closed. A package may be suspended on the vertical interior side of the front door by placing it within the elastic, which will then hold it by friction against the interior of the front door. When the front door is opened the package is moved even further outward and upward than if it were on the box tray. When the package is removed, the slanted slots of the side panels of the door allow the fasteners to slide closer to the top of the door and thus make it even easier to remove the package from the elastic loop suspending it. In addition, the side panels of the front door are not exactly perpendicular to the front door itself, being slightly slanted inward. Thus, the angle made by the panels and door may be 80 degrees or 85 degrees or so on, rather than exactly 90 degrees. This slight inward camber allows the fasteners to slide even more easily.

An optional letter slot in the mailbox may allow letters to fall to a slanted chute which in turn allows the letters to slide downward into a letter drawer which may be easily withdrawn via the rear door of the mailbox.

In addition, the invention (in the optional curbside embodiments) may also have interchangeable bonnets, the top of the column which prevents rain from entering the mailbox and has the letter slot to allow the letters to be deposited in the mailbox as described in the previous paragraph. For example, the bonnet may have a solar cell powering a house number light or an interior light for the box. The bonnet may contain machinery including a scanner and solenoid operative to scan a bar code and then open the front door if the bar code is correct. The bonnet machinery may also be connected to a home safety system such as a "First Alert"® elder monitor system or a home security system, and when activated, may turn on the exterior light on the mailbox, thus alerting returning home owners that their house has been broken into, or more easily alerting first responders such as ambulance drivers responding to a First Alert® call as to exactly which house is the correct house. An external camera may provide extra security and an internal camera may send a text message with an image of the interior of the mailbox so the home owner will know what is in the mailbox.

Note that for the wall insert version, there is no bonnet. Discussions of bonnets in this application refer only to the curbside model, not to the wall insert model.

These, and other, embodiments of the invention will be better appreciated and understood when considered in conjunction with the following description and the accompanying drawings. It should be understood, however, that the following description, while indicating various embodiments of the invention and numerous specific details thereof, is given by way of illustration and not of limitation. Many substitutions, modifications, additions and/or rearrangements may be made within the scope of the invention without departing from the spirit thereof, and the invention includes all such substitutions, modifications, additions and/or rearrangements.

SUMMARY IN REFERENCE TO THE CLAIMS

It is therefore a first aspect, advantage, objective and embodiment of the present invention to provide a residential mailbox for use with boxes, the residential mailbox for mounting in a home wall having an exterior face and an exterior, and interior face and an interior, the residential mailbox comprising:

a columnar body having a vertical axis and a front and a back;

the columnar body mounted into such home wall, with the front passing through such exterior face of such home wall and accessible from such exterior, and with the back passing through such interior face of such home wall and accessible from such interior;

the front having a first door therein, the first door forming part of the front when in a closed position, the first door having at least one hinge allowing it to move to an open position by swinging outward at a top end;

the first door having at least one member extending from a bottom end of the first door inside of the columnar body;

a box drawer disposed within the columnar body, resting upon the at least one member when the first door is in the closed position, a center of gravity of the box drawer disposed on the at least one member of the first door, whereby the at least one member of the first door provides stable support for the box drawer.

It is therefore a second aspect, advantage, objective and embodiment of the present invention to provide a residential mailbox further comprising:

the back having a second door therein, the second door forming part of the back when in a closed position, the second door having at least one hinge allowing it to move to an open position by swinging outward at a top end;

the second door having at least one member extending from a bottom end of the second door inside of the columnar body, the member of the second door being disposed so that the member of the first door and the member of the second door do not occlude one another;

the center of gravity of the box drawer disposed on the at least one member of the second door, whereby the at least one member of the second door provides stable support for the box drawer.

It is therefore another aspect, advantage, objective and embodiment of the present invention to provide a residential mailbox further comprising:

the front door having two side panels, the side panels concealed within the columnar body in the closed position, each side panel having a respective slot therethrough, each slot being oriented at an angle to the vertical axis when in the closed position;

an elastic member having two ends, each end having a respective fastener thereon, each fastener sliding within one slot whereby the elastic member is suspended loosely between the two slots and may move along the slots.

It is therefore another aspect, advantage, objective and embodiment of the present invention to provide a residential mailbox, the side panels further comprising:

a relative angle between the front door and the side panels of slightly less than 90 degrees.

It is therefore another aspect, advantage, objective and embodiment of the present invention to provide a residential mailbox, for use with letters, the residential mailbox further comprising:

a slanted chute inside the residential mailbox, the slanted chute disposed so as to receive such letters entering the mailbox via a first letter delivery slot, the slant of the chute allowing such letters to slide into a first letter drawer.

It is therefore another aspect, advantage, objective and embodiment of the present invention to provide a residential mailbox, further comprising:

the front door having at least one member extending from a bottom end of the front door inside of the columnar body;

a box drawer disposed within the columnar body, resting upon the at least one member when the front door is in the closed position, whereby when the front door is opened, the box drawer is lifted upward and rotated out the front of the columnar body.

INDEX TO THE REFERENCE NUMERALS

Mailbox 100
Delivery door 102
Delivery aperture 104
Hinges 106*a*, 106*b*
Latch 108
Bonnet 110
House number 112
Flag 114
Letter chute 116
Letter drawer 118
Slanted slot 120
Fastener/rider 122
Base 124
Fingers (front door) 126
Fingers (rear door) 128
Column 130
Front door ass'y 202
Rear door ass'y 204
Frame members 206*a*, 206*b*
Side assemblies 208
Bonnet 210
Base assembly 212
Bottom 214
Box shelf 216
Letter drawer 218
Upper shelf 220
Letter chute 222
House number assembly 224
Slanted slot 226
Letter aperture 228
Fingers (front door) 230
Fingers (rear door) 232
Front door side panel 234
Rear door side panel 236
Mailbox 600
Front door ass'y open 602
Front door side panel 604
Box drawer (in front door) 606
Mailbox 700
Rear door ass'y open 702
Rear door side panel 704
Box drawer (on rear door)706
Front door assembly 800
Front door side panel 802
Angled slot on side 806
Fastener 808
Elastic cord 810
Solenoid 812
Mailbox 900
Plain bonnet 902
Enhanced bonnet 904
Bonnet 1000
RF transceiver 1002
Barcode scanner 1004
LED light 1006
Internal camera 1008
External camera 1010
Controller 1012
NV memory 1014
Data bus 1016
Power lines 1018
Power supply 1020
Battery 1022
AC power 1024
Solar power 1026
Cellular module 1028
Verisign® module 1030
Voice in/out 1032
Screen/audio 1034
Text msg module 1036
Mailbox 1100
Security light 1102
Connection to home safety system 1104
360 view camera 1106
Solar power cell 1108
Bar code scanner 1110
Wall insert embodiment 2000
Exterior of home 2002
Interior of home 2004
Exterior face of wall 2006
Wall 2007
Interior face of wall 2008
Members/fingers 2010
Vertical axis 2012

BRIEF DESCRIPTION OF THE DRAWINGS

The following drawings form part of the present specification and are included to further demonstrate certain aspects of the present invention. The invention may be better understood by reference to one or more of these drawings in combination with the detailed description of specific embodiments presented herein.

FIG. 1 is a transparent front side view of the invention showing the front (delivery person) door and an aperture for depositing mail.

FIG. 2 is a transparent side view of the invention showing a house number and in partial transparency, details of the mail chute and return package holder of the invention.

FIG. 3 is an elevation perspective view of the mail box showing the top bonnet, front and side of the invention.

FIG. 4 is a bottom view of the invention showing details of the fingers on both front and back door which allow the box drawer in the bottom of the box to be lifted out by either door.

FIG. 5 is an exploded view of the components of the invention, including the front door, back door, sides, base parts, drawers, chute, bonnet, number sign and so on.

FIG. 12 is a perspective elevated oblique view of a wall insert embodiment of the invention showing the planes of the interior and exterior faces of a wall in which the mailbox is set.

FIG. 13 is a top cross-sectional view of the wall insert embodiment of the invention showing the interleaving but non-occlusive members/fingers of the invention which allow the box drawer to raise up either toward the front door or toward the rear door.

FIG. 14 is a non-transparent cross-sectional view of the wall insert embodiment of the invention showing how it would look if the wall were cross-sectioned at a point which does not cross-section the mailbox.

FIG. 15 is a side view of the invention showing the vertical axis.

FIG. 16 is a side view similar to FIG. 14 but with the invention shown transparent and a wall cross-sectioned to show the interior and exterior faces of the wall.

DETAILED DESCRIPTION OF DRAWINGS

Glossary

Figure 5:
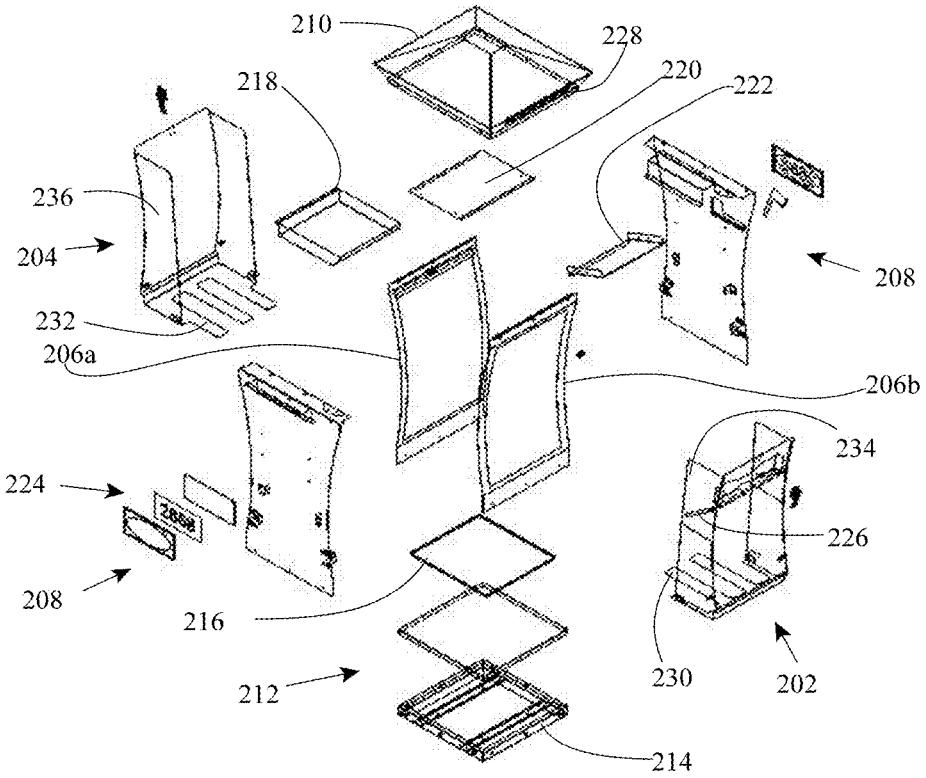

For purposes of this application and claims, the term slightly less than 90 degrees means an angle of 80 to 89.99 degrees.

For purposes of this application and claims, columnar means having the general aspect of a column e.g. being tall and narrow. In the presently preferred embodiments of the present invention, this includes being a generally rectanguloid body oriented with a vertical axis which is longer than the two horizontal axes.

An elastic member for purposes of this application and claims refers to items such as bungy cords, stretchable cords, rubber or polymer strings and cables, elastic bands such as are used in clothing and the like.

A wall insert mailbox means a mailbox which is not free standing but rather is inserted through the wall of a home so that the front door is on the exterior of the home and the rear door is on the interior of the home (or vice-versa within the claims below). The interior means the inside of the home, while the exterior means outside the home. No claim is made to home interiors nor to home exteriors. The interior face of the wall of the home is that face of the wall which faces the interior, the exterior face obviously faces the exterior. The wall may be solid and still have two faces. No claim is made to walls.

A curbside mailbox on the other hand is free standing, for example, by the curb of a street or on a boulevard or yard.

End Glossary

FIG. 1 is a transparent front side view of the optional curbside embodiment of the invention showing the front (delivery person) door and an aperture for depositing mail, and FIG. 2 is a transparent side view of the invention showing a house number and in partial transparency, details of the mail chute and return package holder of the invention. FIG. 3 is an elevation perspective view of the mail box showing the top bonnet, front and side of the invention and FIG. 4 is a bottom view of the invention showing details of the fingers on both front and back door which allow the box drawer in the bottom of the box to be lifted out by either door.

Mailbox 100 has a generally rectangular columnar body 130 which narrows a bit near the middle. Delivery door 102 is also called the front door in this application, and with delivery aperture 104 is oriented toward the street, so that a delivery person in a vehicle can easily open either the door 102 or the aperture 104 and insert either a box (through the door 102) or a letter (through aperture 104). It may also be the "first" door, or it may be a "second" door.

One very important feature of the invention is that the pan/drawer in the bottom of the body which holds boxes and packages may be raised up and lifted toward either the front door or the back door upon opening. This, and equipment to allow easy access to a box by a delivery person seated in a vehicle (rather than getting out of their vehicle in the street) are much more important than the mere provision of two doors, and will be discussed in greater detail elsewhere.

Hinges 106*a*, 106*b* respectively serve the front door 102 and the owner's door, the back door, which faces away from the street so that the home owner may easily and safely open the mailbox without stepping into the street. Again, this embodiment is a curbside option, not the wall insert version.

Latch 108 may be manual, keyed or keypad or combination or the like, or it may be automated, operated by an actuator such as a solenoid, and controlled by a bar code scanner or the like.

Bonnet 110 may be an important part of the invention. In particular, the invention may have a "basic" bonnet which is nothing more than a rain hat or roof to keep the elements out of the columnar body of the mailbox, or it may be an "enhanced" or upgraded bonnet having a solar cell and various electrical functionality described later, including lights and so on.

Note that the wall insert version discussed in regard to FIGS. 12 through 16 may not have any bonnet. It may also have a modular insert offering the functionality of the bonnet is shape different than the bonnets depicted.

House number 112 may be seen to be a multi-layer structure and may have a glowing or light emitting background allowing the house number to be more easily seen in low-light conditions such as bad weather or night-time. The house number 112 may be present on one or both sides of the invention, and may also be present, in alternative embodiments, on the front or rear doors. For the wall insert embodiments of FIGS. 12 et seq., the home number may be best found on a part projecting from the exterior face of the wall, such as the front door, while the rear projecting part such as the rear door may simply say "mail" or the like.

Flag 114 may be raised and lowered to indicate the presence of mail. However, there are better and more modern ways to indicate mail arrival, as discussed below.

Letter chute 116 is a generally smooth and slanted surface which is located just below the aperture 104, allowing letters to slide gently downward, and further into the columnar body toward the rear, until they land in letter drawer 118. It may be seen in later diagrams that letter drawer 118 slides out of the rear of the body when the rear door is opened, allowing the homeowner to obtain typical letter type mail without bending down.

Slanted slot 120 is located on the side panel of the front door, and carried in it fastener/rider 122, which in turn carries one end of an elastic cord, such as a thin "Bungy" cord or the like. A matching slanted slot and rider on another side panel of the front door carry the other end of the cord. The cord may be used to retain a package to be returned, that is, a package which the homeowner has placed in the box for the delivery person to pick up. (This happens for example when an online product is returned.) When the elastic cord is placed around a returned package, the package will cling to the interior of the front door 102. When the front/delivery door 102 is opened, the package will be carried forward toward the delivery person, making it easier for the delivery person to pick up the box. The fingers on the front door 126 (seen in FIG. 4), will also lift up a pan in the bottom of the column 130 so that the returned package will be lifted from the bottom as well.

Base 124 may be materials designed to withstand contact with the ground, such as stainless steel or the like.

Fingers (front door) 126 and fingers (rear door) 128 will both lift the same pan from the bottom of the columnar body 130 toward whichever direction the box is opened from. Thus, if the homeowner opens the rear door, the pan is lifted toward the rear, but if the delivery person opens the front door, the same pan is lifted toward the front.

FIG. 5 is an exploded view of the components of the invention, including the front door, back door, sides, base parts, drawers, chute, bonnet, number sign and so on. Front door ass'y 202 has two side panels (which are not the same as the side assemblies (208)). The front door assembly 202 carries an elastic member in two slanted slots 226 in the sides of the front door. The front door sides may be not quite parallel but may slant inward just a very small amount, a few degrees. This in turns mean that when the elastic cord is pulled outward by a someone putting a package into the elastic, the elastic cord ends (on small riders in the slanted slots 226) are pulled to parts of the side panels which are closer, loosening the elastic and making removal or insertion of the package easier.

Rear door ass'y 204 and the front door 202 fit between frame members 206*a*, 206*b* and then with side assemblies 208 forms the columnar body Bonnet 210 is interchangeable without disturbing other structures of the invention. Thus, one bonnet 210 may be removed without any other part of the columnar body being removed, then the bonnet 210 may be replaced with another bonnet.

Base assembly 212 of the curbside version (not the wall insert version discussed below) is designed to be seated either directly into the earth or into a foundation of some type, without excessive degradation, rust or rot. Bottom 214 does not hold box shelf 216 directly, rather, the front door fingers 230 and the rear door fingers 232 actually hold the box shelf 216. When either door is opened, that set of fingers then raise the box shelf along with any parcel sitting on the bottom of the box, and turn it while moving it sideways toward the direction of the door being opened: at the end of the door's swing, the package on the box shelf 216 will actually be largely outside of the columnar body. It will be understood that either alone and both sets of members/fingers provide stability to the box drawer either sitting on the base unopened, or when one door is opened, provide stability as the box drawer is lifted and rotated toward that door. The center of gravity of the box drawer rests within the outline/ambit of either set of fingers individually or both.

Letter drawer 218 on the other hand is designed in the best mode now contemplated and presently preferred embodiment to slid out only toward the rear when the rear door is opened. (Letters are only deposited from the front, via aperture 228).

Upper shelf 220 holds the letter drawer 218.

Letter chute 222 gently slides anything deposited in letter aperture 228 down to the letter drawer 218.

House number assembly 224 may include a glowing back panel to that the numbers of the home are more clearly visible in low light.

Front door side panel 234 carries on it the slanted slot which in turn carries the rider, which in turn is attached to the end of an elastic cord.

Rear door side panel 236 on the other hand may not have these parts, in embodiments.

Figure 6:
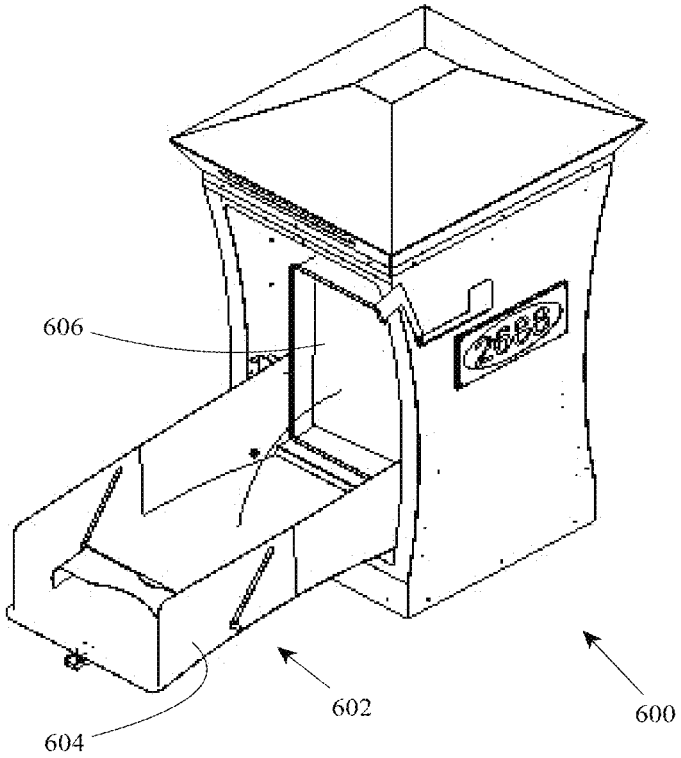
FIG. 6 is a non-transparent side view of the box of the invention with the front door open, showing the box shelf lifted by the fingers of the front door.

FIG. 6 is a non-transparent side view of the box of the invention with the front door open, showing the box shelf lifted by the fingers of the front door, with stability since the center of gravity is within the area/ambit/outline of the fingers of the front door.

Mailbox 600 is shown with the front door ass'y 602 open. It may immediately be seen that the box shelf 606 and the front door side panel 604 will push any package which was sitting in the box shelf 606 to the center of the front door and further will push it outward from the columnar body and closer to the door opener. This is true even if the elastic cord stretched between the slanted slots is not used to hold the package.

Box drawer 606 is depicted here in a rather "tray-like" shape, however, the preferred embodiment is not necessarily like this: the tray shape is obviously easier to see at the angle of this view. It may be higher sided, or a flat plate, or omitted: within the scope of the claims the box drawer may be defined to be simply the fingers/members themselves.

Figure 7:
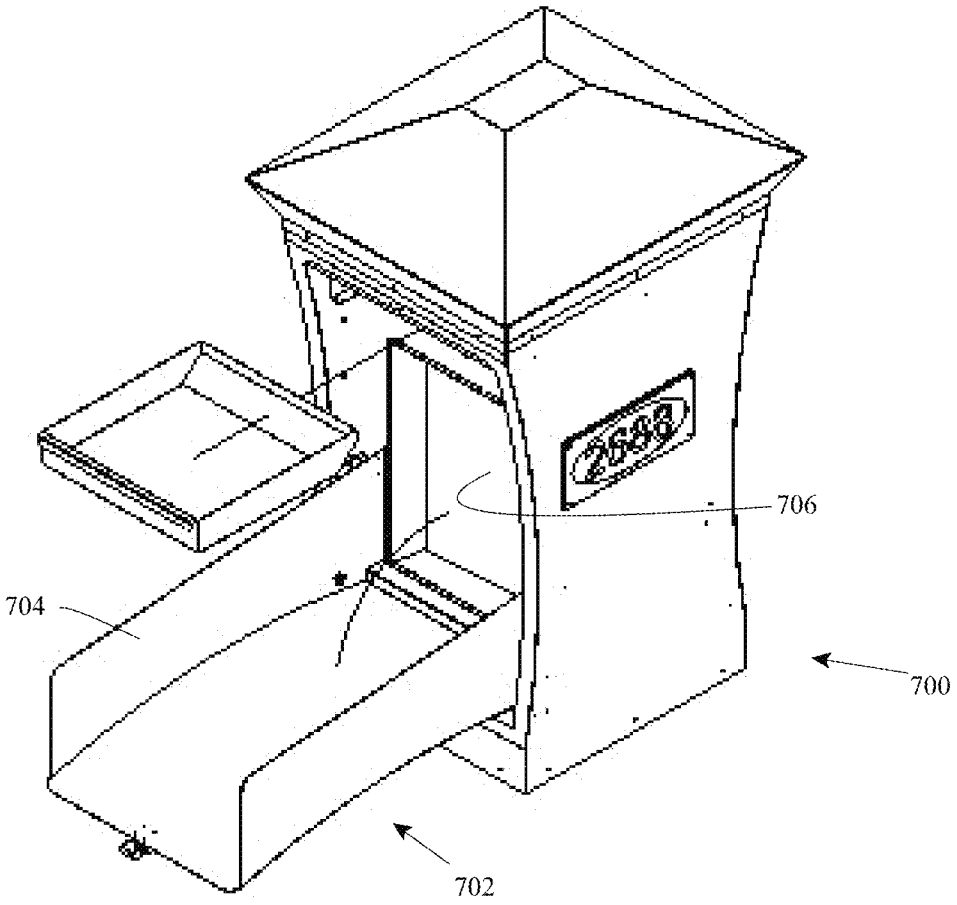
FIG. 7 is a non-transparent side view of the box of the invention with the back door open, showing the same box shelf is now lifted by the fingers of the back door.

FIG. 7 is a non-transparent side view of the box of the invention with the back door open, showing the same box shelf is now lifted by the fingers of the back door.

Mailbox 700 is shown with the rear door assembly 702 open, which can be carefully contrasted with the previous view (FIG. 6). It may immediately be seen in this FIG. 7 that the box shelf 706 and the rear door side panel 704 will serve like fences or rails and push any package which was sitting in the box shelf 706 to the rear door interior and further will push it outward from the columnar body and closer to the individual opening the door. Note that in presently preferred embodiments the rear door 702 has no elastic cord, slanted slots, etc.

Box drawer 706 is again depicted here in a rather "tray-like" shape, however, the preferred embodiment is not necessarily like this: the tray shape is obviously easier to see at the angle of this view. The box shelf may be flat just as easily.

Figure 8:
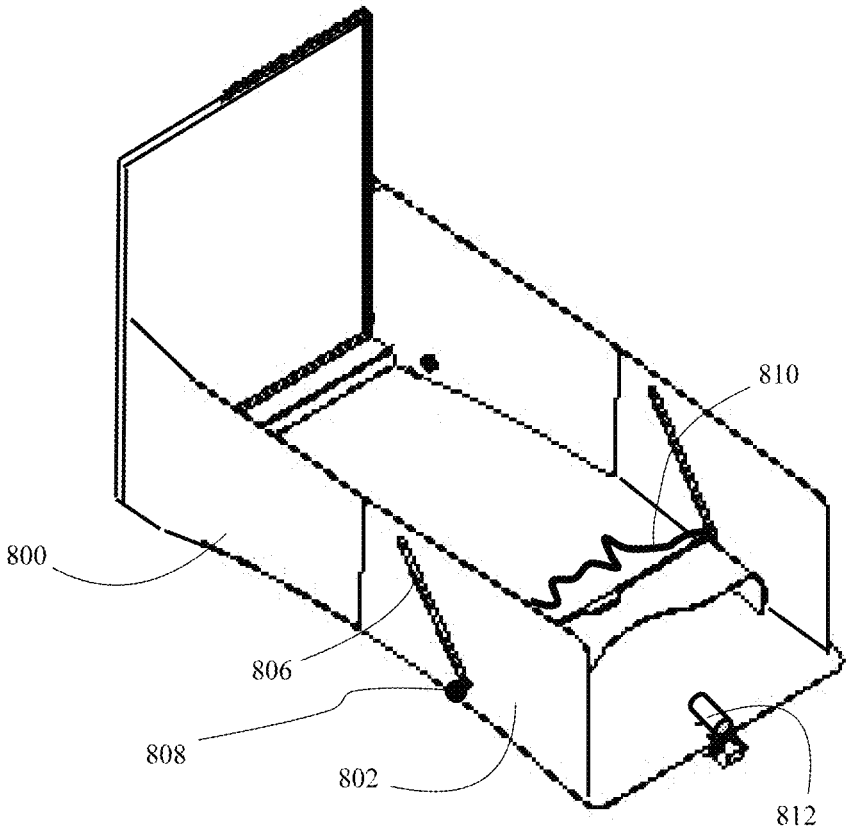
FIG. 8 is a view of the front door assembly, including not just the one-piece front door but also the two angled slots on the door side panels, the bungy cord and the fasteners holding the bungy cord to the slots.

FIG. 8 is a view of the front door assembly, including not just the one-piece front door but also the mail chute and aperture, the two angled slots on the door side panels, the bungy cord and the fasteners holding the bungy cord to the slots, all of which together comprise the convenience features for a delivery person accepting a returned package from the box.

Front door assembly 800 has front door side panel 802 which in turn has angled slot 806. The angled slot 806 has a rider/fastener 808 (rather like the aglet of a shoelace but wider) therein which prevents the end of the elastic cord 810 from coming free, but which allows the elastic cord and rider to move back and forth along the slot. Note that the side panel 802 is not quite perpendicular to the front door itself, rather the side panels may be slanted toward one another just a bit so that when the rider moves along the slot toward the edge of the panel, some slack is generated in the elastic cord.

Solenoid 812 is depicted in this embodiment as being on the door, but it may also be on the bonnet to make for easy retrofitting. The solenoid 812 may automatically open the door or unlock the door when a scanner indicates the presence of the correct bar code, or a keypad combination is entered corrected, a text message is received, and so on.

Figure 9:
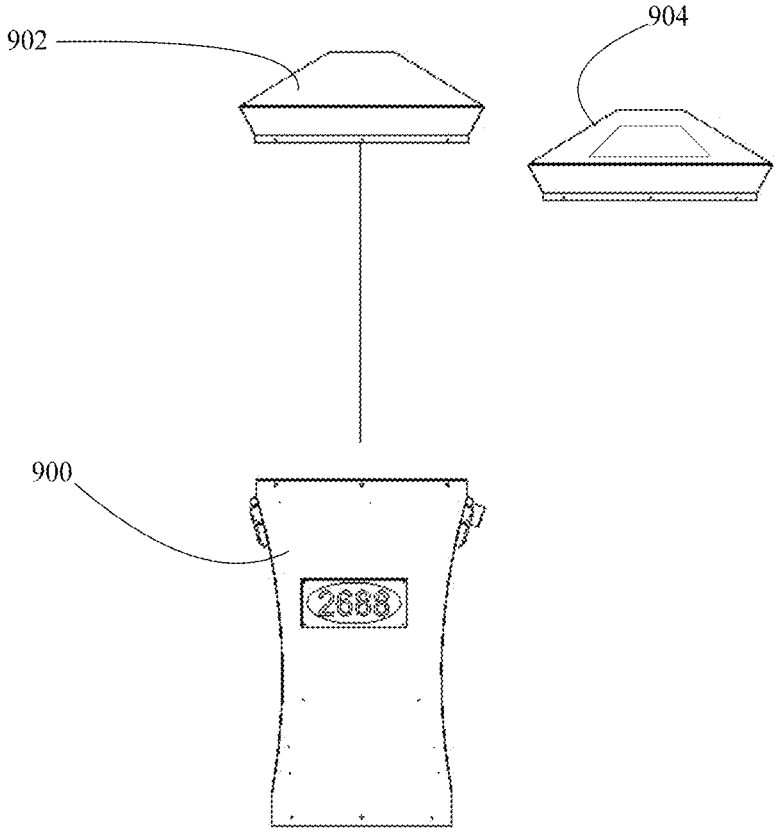
FIG. 9 is a view of the assembled box similar to FIG. 3, but showing that optionally a second interchangeable bonnet may be provided as part of the invention.

FIG. 9 is a view of the assembled box similar to FIG. 3, but showing that optionally a second interchangeable bonnet may be provided as part of the invention.

Mailbox 900 may have both a plain bonnet 902 and an enhanced bonnet 904 which may be sold together with the device, or may be sold separately. In one mode of employment, the device may be sold to a developer with the basic bonnet only, while the homeowners may then be offered the option to buy the enhanced bonnet. Either way, it is possible to remove either bonnet without disturbing the overall structure or the columnar body, and replace it. If solar power is used and wireless communication, and if the front door solenoid is located in the bonnet rather than the door, then no wiring work at all need be done to carry out the retrofit.

Figure 10:
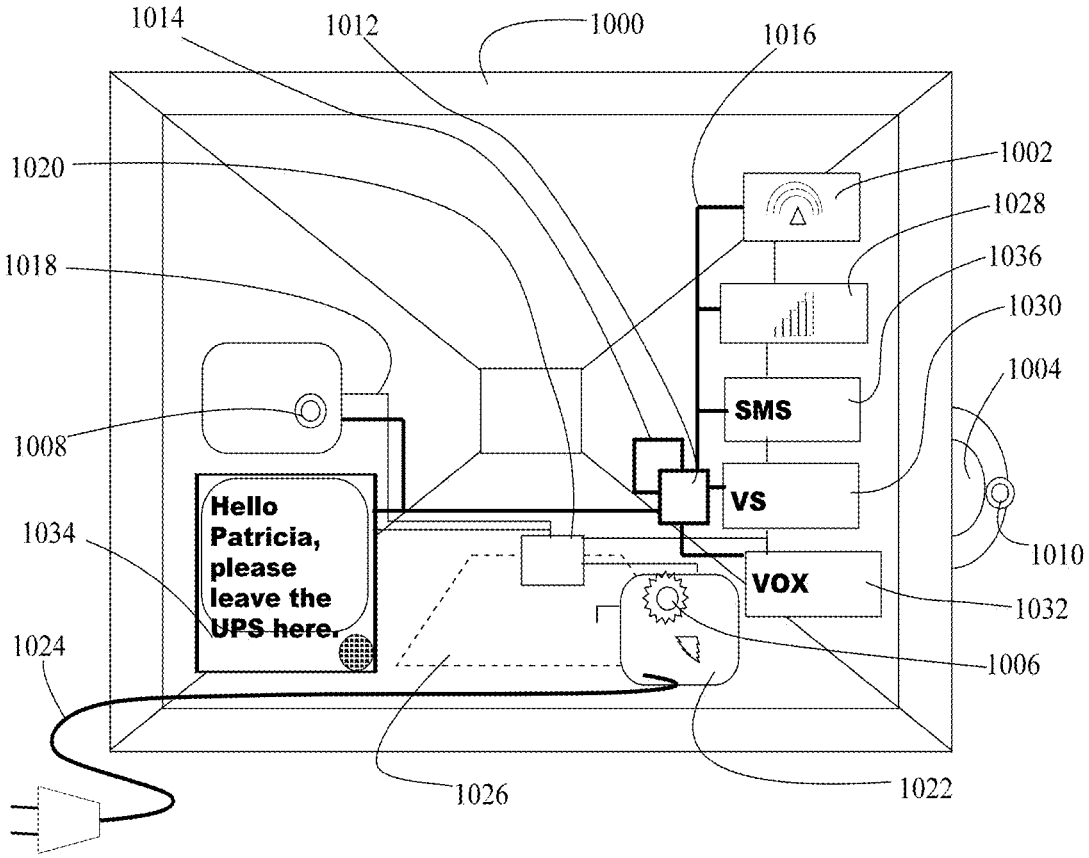
FIG. 10 is an underside view of a bonnet having electrical features including an internal light, internal and external cameras, a bar code scanner and supporting equipment.

FIG. 10 is an underside view of a bonnet having electrical features including an internal light, internal and external cameras, a bar code scanner and supporting equipment. Bonnet 1000 may have therein an RF transceiver 1002 such as might be used with Bluetooth® or Wifi® applications or with longer range (such as citizen's band). By this means, or by means of cellular service module 1028, or a data hardwire, it may communicate with the owner's mobile devices (such as telephones) and equally importantly, it may communicate with home safety services such as home security systems or LifeAlert®, which monitors people with dangerous conditions. In addition, it may provide a security camera useful for the homeowner to see not only who is accessing their mailbox and also to view the area about the mailbox, up and down the street, and so on.

Barcode scanner 1004 is one of the most innovative features of the present invention. When a buyer wishes to return an online purchase, the buyer usually prints out, from the seller, a mailing label having a barcode. The buyer places the mailing label on the package and then the mailing charge is paid by the seller. In the present invention, the buyer may furthermore communicate the mailing label to the mail delivery person, for example, by emailing an image of the mailing label with its barcode. The homeowner/buyer may then inform the advanced mailbox of the present invention (with the enhanced bonnet) of the barcode number, and place the labeled package into the mailbox, presumably using the elastic cord on the delivery person's door. When the delivery person comes to the box, they scan the barcode they have printed out, which the mailbox recognizes and based on that bar code, the mailbox activates the actuator which opens the front door so the mailperson may retrieve the package.

LED light 1006 may illuminate the interior of the mailbox so that internal camera 1008 may show the homeowner, via cellular module 1028 or RF 1002 (for example sending a text or MMS message including a photo or video) the contents of the box.

External camera 1010 on the other hand, like the 360-camera discussed previously, may show the surroundings of the box: the person accessing the box, the street, the front yard etc.

Controller 1012 and non-volatile memory 1014 will be understood to provide control over the functions of the advanced bonnet, by way of data bus 1016 and/or power lines 1018.

Power supply 1020 may distribute power and in embodiments may control power sources, for example, switching to receiving power from solar power cell 1026 when it is generating electricity or switching to the battery 1022 when solar power is unavailable. Note that various combinations of these three power supplies mean that depending on embodiment, any could become optional.

Verisign® module 1030 would be an example of the manner in which the mailbox could cooperate with electronic signature systems to allow access to the box, and another potential method would be voice input/output 1032 (allowing speech recognition or simply use as a call box via screen/audio 1034).

Text message module 1036 could allow the device to send notifications to the user via cell service module 1028: the text module 1036 may format the messages, use the camera to take photos, select from various pre-supplied text messages and so on and so forth.

Figure 11:
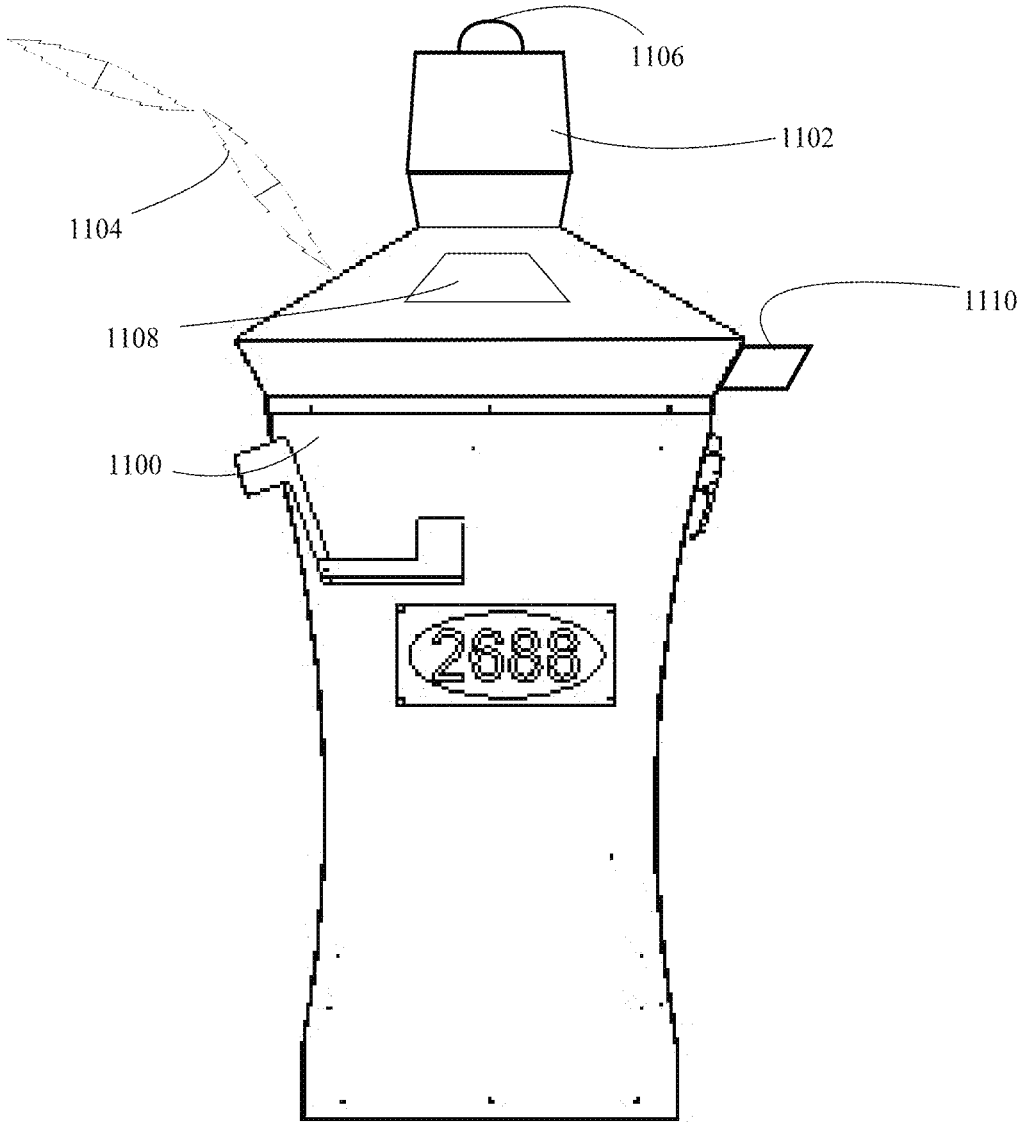
FIG. 11 is a picture of an assembled box similar to FIG. 3 but also showing the security warning and identification lights and an RF connection to a home security/medical system.

FIG. 11 is a picture of an assembled box similar to FIG. 3 but also showing the security warning and identification lights and an RF connection to a home security/medical system.

Mailbox 1100 has a security light 1102 atop it. Note that in this simplified representation the light is depicted rather like an old-fashioned police car spinning light, however it is more likely that the light preferred will be LED, may be mounted to one side, and is likely to be shaped considerably more esthetically.

Connection to home safety system 1104 may be wireless, and may be wifi or other short-range radio, may be cellular service, or may be wired.

360 view camera 1106 may be replaced with a remote-controlled camera, may be replaced with multiple cameras facing different directions, etc. It is shown enclosed in a weather protective bubble.

Solar power cell 1108 frees the device from wired power.

Bar code scanner 1110, as discussed previously, allows the device to be pre-programmed on a daily basis or as-needed basis to open when a particular bar-code/QR code is presented to the scanner.

FIG. 12 is a perspective elevated oblique view of a wall insert embodiment of the invention showing the planes of the interior and exterior faces of a wall in which the mailbox is set. Wall insert embodiment 2000 will protrude slightly through a wall, or may be inset into the wall with recesses on one or both sides.

Exterior of home 2002 and the interior of the home 2004 are obviously defined and separated by the wall 2007 (see FIG. 14 briefly). The construction of the wall 2007 is irrelevant to the invention, as thinner walls may allow more projection on one or both sides, while thicker walls may be penetrated by recesses and the mailbox. Materials are also irrelevant and the wall may be wallboard and stringer construction, solid, brick faced, plaster and lathe, etc.

Returning to FIG. 12, exterior face 2006 of wall 2007 faces exterior 2002, while interior face 2008 faces interior 2004.

Wall 2007 depicted is rather thick, being almost as wide as the mailbox 2000, but this is merely exemplary.

FIG. 13 is a top cross-sectional view of the wall insert embodiment of the invention showing the interleaving but non-occlusive members/fingers of the invention which allow the box drawer to raise up either toward the front door or toward the rear door.

Members/fingers 2010, as discussed previously, function to raise and rotate a box toward whatever door is opened, providing stability as a box in the mailbox will have stability provided by the fingers/members 2010. When either door is opened, that set of fingers which is connected to the bottom of that door then raise the box (or the box drawer along with any parcel sitting on the bottom of the box) and turn it while moving it sideways toward the direction of the door being opened: at the end of the door's swing, the package on the box shelf will actually be largely outside of the columnar body. It will be understood that either set of members alone and both sets of members/fingers together provide stability to the box drawer either sitting on the base unopened, or when one door is opened, provide stability as the box drawer is lifted and rotated toward that door. The center of gravity of the box drawer rests within the outline/ambit of either set of fingers individually or both.

FIG. 14 is a non-transparent cross-sectional view of the wall insert embodiment of the invention showing how it would look if the wall were cross-sectioned at a point which does not cross-section the mailbox.

FIG. 15 is a side view of the invention showing the vertical axis.

Vertical axis 2012 may be seen as the invention is advantageously proportioned. Note that the word "axis" does not imply that the mailbox rotates. This axis is not an axis of rotation of any part of the device.

FIG. 16 is a side view similar to FIG. 14 but with the invention shown transparent and a wall cross-sectioned to show the interior and exterior faces of the wall.

The side panels may be partially seen behind the wall faces.

Throughout this application, various publications, patents, and/or patent applications are referenced in order to more fully describe the state of the art to which this invention pertains. The disclosures of these publications, patents, and/or patent applications are herein incorporated by reference in their entireties, and for the subject matter for which they are specifically referenced in the same or a prior sentence, to the same extent as if each independent publication, patent, and/or patent application was specifically and individually indicated to be incorporated by reference.

It will be understood that references to "curbside" mailboxes, bonnets, tops, items on the side and so forth are for the curbside embodiment.

Methods and components are described herein. However, methods and components similar or equivalent to those described herein can be also used to obtain variations of the present invention. The materials, articles, components, methods, and examples are illustrative only and not intended to be limiting.

Although only a few embodiments have been disclosed in detail above, other embodiments are possible and the inventors intend these to be encompassed within this specification. The specification describes specific examples to accomplish a more general goal that may be accomplished in another way. This disclosure is intended to be exemplary, and the claims are intended to cover any modification or alternative which might be predictable to a person having ordinary skill in the art.

Having illustrated and described the principles of the invention in exemplary embodiments, it should be apparent to those skilled in the art that the described examples are illustrative embodiments and can be modified in arrangement and detail without departing from such principles. Techniques from any of the examples can be incorporated into one or more of any of the other examples. It is intended that the specification and examples be considered as exemplary only, with a true scope and spirit of the invention being indicated by the following claims.

What is claimed is:

1. A residential mailbox for mounting in a home wall having an exterior face and an exterior, and interior face and an interior, the residential mailbox comprising:

a columnar body having a vertical axis and a front and a back;

the columnar body mounted into the home wall, with the front passing through the exterior face of such home wall and accessible from such exterior, and with the back passing through the interior face of the home wall and accessible from the interior;

the front having a first door therein, the first door forming part of the front when in a closed position, the first door having at least one hinge allowing it to move to an open position by swinging outward at a top end;

the first door having at least one member extending from a bottom end of the first door inside of the columnar body;

a box drawer disposed within the columnar body, resting upon the at least one member when the first door is in the closed position, a center of gravity of the box drawer disposed on the at least one member of the first door, whereby the at least one member of the first door provides stable support for the box drawer.

2. The residential mailbox of claim 1, further comprising:

the back having a second door therein, the second door forming part of the back when in a closed position, the second door having at least one hinge allowing it to move to an open position by swinging outward at a top end;

the second door having at least one member extending from a bottom end of the second door inside of the columnar body, the at least one member of the second door being disposed so that the at least one member of the first door and the at least one member of the second door do not occlude one another;

the center of gravity of the box drawer disposed on the at least one member of the second door, whereby the at least one member of the second door provides stable support for the box drawer.

3. The residential mailbox of claim 2, further comprising:

a slanted chute inside the residential mailbox, the slanted chute disposed so as to receive letters entering the mailbox via a first letter delivery slot, the slant of the chute allowing the letters to slide into a first letter drawer.

4. The residential mailbox of claim 1, further comprising:

the front door having two side panels, the side panels concealed within the columnar body in the closed position, each side panel having a respective slot therethrough, each slot being oriented at an angle to the vertical axis when in the closed position;

an elastic member having two ends, each end having a respective fastener thereon, each fastener sliding within one slot whereby the elastic member is suspended loosely between the two slots and moves along the slots.

5. The residential mailbox of claim 4, the side panels further comprising:

a relative angle between the front door and the side panels of slightly less than 90 degrees.

* * * * *